US008251717B2

(12) United States Patent
Liao et al.

(10) Patent No.: US 8,251,717 B2
(45) Date of Patent: Aug. 28, 2012

(54) ELECTRICAL CONNECTOR

(75) Inventors: Chi-Nan Liao, New Taipei (TW); Tzu-Fan Kuo, New Taipei (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/105,942

(22) Filed: May 12, 2011

(65) Prior Publication Data

US 2011/0281471 A1 Nov. 17, 2011

(30) Foreign Application Priority Data

May 12, 2010 (TW) ..... 99208860 U

(51) Int. Cl.
*H01R 13/648* (2006.01)
*H01R 4/66* (2006.01)

(52) U.S. Cl. ..... 439/95

(58) Field of Classification Search ..... 439/660, 439/79, 95, 101, 607.23, 607.01
See application file for complete search history.

(56) References Cited

U.S. PATENT DOCUMENTS 6,811,439 B1 * 11/2004 Shin-Ting ..... 439/607.31
7,229,298 B2 6/2007 Shen et al.

* cited by examiner

*Primary Examiner* — Javaid Nasri
(74) *Attorney, Agent, or Firm* — Wei Te Chung; Andrew C. Cheng; Ming Chieh Chang

(57) ABSTRACT

An electrical connector includes an insulative housing having a base portion extending along a front-to-rear direction and a strengthening rib protruding outwardly from an outer circumstance of a front end of the base portion. At least one receiving recess is defined on the strengthening rib and opened upwardly via an opening defined on an upper face of the strengthening rib. A plurality of contacts are secured in the insulative housing. A metallic shell surrounds the base portion and includes at least one retaining plate received in the receiving recess. A transverse width of the receiving recess becomes narrower and narrower in a vertical direction perpendicular to the front-to-rear direction so as to keep the retaining plate being secured.

8 Claims, 6 Drawing Sheets

ELECTRICAL CONNECTOR

BACKGROUND OF THE INVENTION

1. Field of the Invention

The present invention relates to an electrical connector, and more particularly to an electrical connector having a metallic shell.

2. Description of the Related Art

U.S. Pat. No. 7,229,298 discloses an electrical connector including an insulative housing, a plurality of contacts arranged as an upper row and a lower row and respectively received in the insulative housing, and a metallic shell surrounding the insulative housing. The insulative housing has an upper wall, a lower wall and a pair of end walls connecting with the upper and lower walls. A plurality of receiving apertures are respectively defined on the upper and lower walls and running through the upper and lower walls. The metallic shell forms a plurality of retaining plates at a front edge thereof and respectively received in the receiving apertures so as to maintain the metallic shell on the insulative housing. However, as the retaining plates are totally embedded in the receiving apertures, which may increase the height of the electrical connector and not advantage for the miniaturization trend of the electrical connector. Obviously, an improved electrical connector is highly desired to overcome the aforementioned problem.

SUMMARY OF THE INVENTION

Accordingly, an object of the present invention is to provide an electrical connector which meet the miniaturization trend.

In order to achieve the object set forth, an electrical connector includes an insulative housing having a base portion extending along a front-to-rear direction and a strengthening rib protruding outwardly from an outer circumstance of a front end of the base portion. At least one receiving recess is defined on the strengthening rib and opened upwardly via an opening defined on an upper face of the strengthening rib. A plurality of contacts are secured in the insulative housing. A metallic shell surrounds the base portion and includes at least one retaining plate received in the receiving recess. A transverse width of the receiving recess becomes narrower and narrower in a vertical direction perpendicular to the front-to-rear direction so as to keep the retaining plate being secured.

Other objects, advantages and novel features of the invention will become more apparent from the following detailed description of the present embodiment when taken in conjunction with the accompanying drawings.

DETAILED DESCRIPTION OF THE INVENTION

Figure 1:
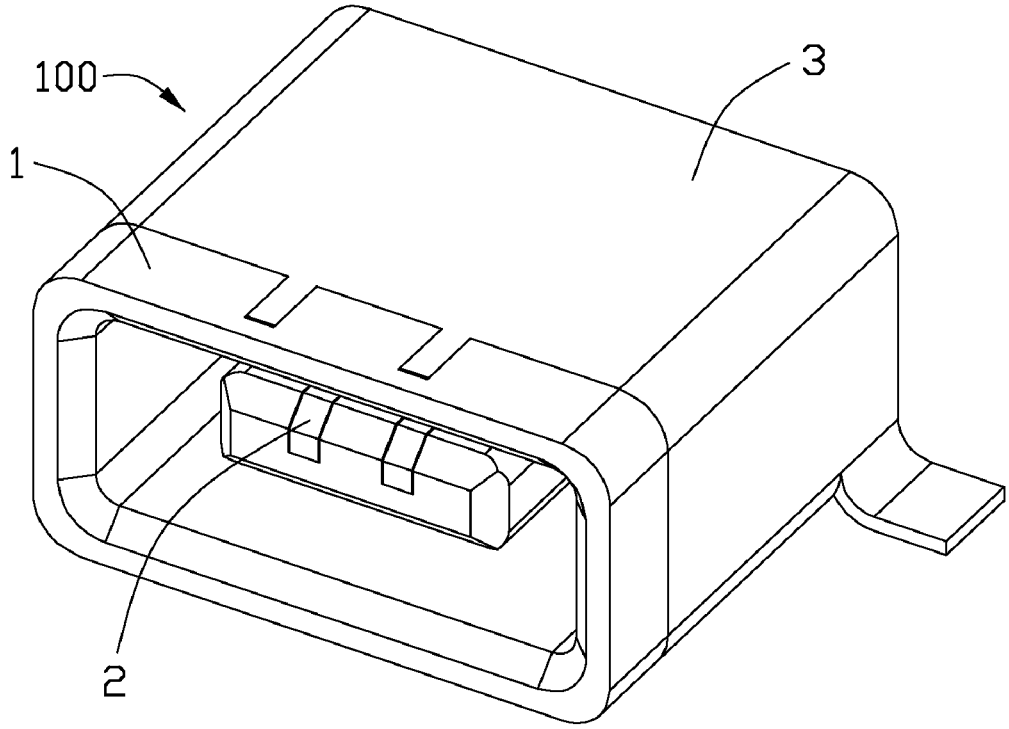
FIG. 1 is a perspective view of an electrical connector in accordance with the present invention.
Figure 2:
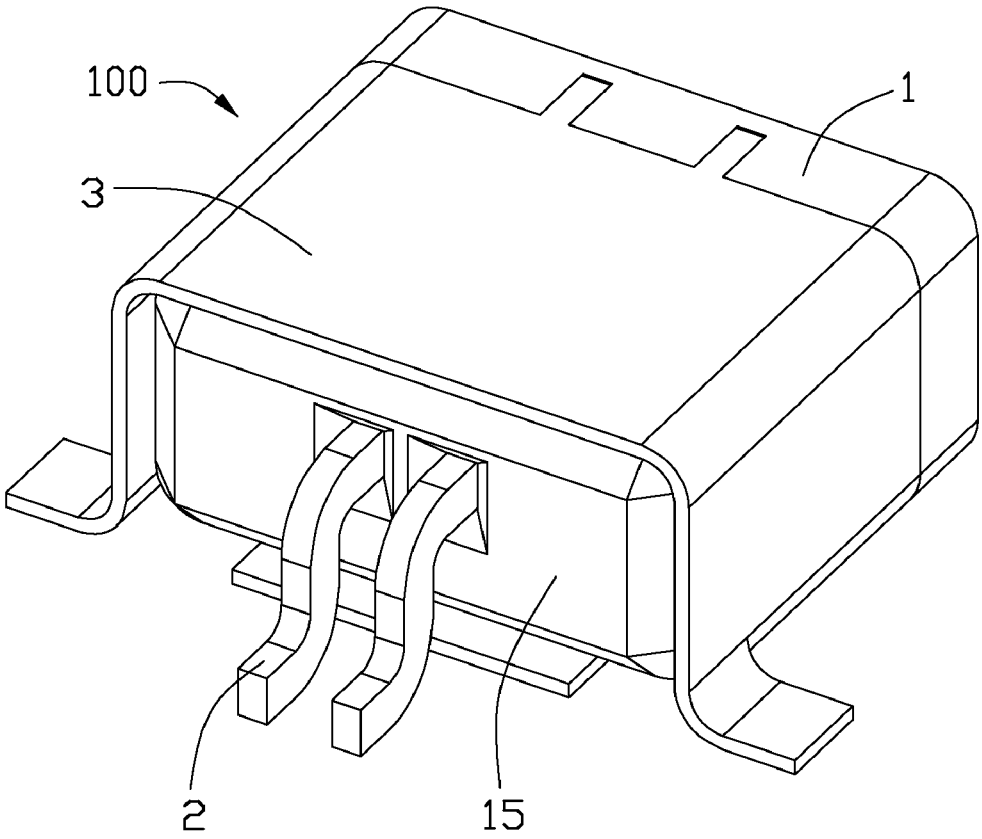
FIG. 2 is another perspective view of the electrical connector shown in FIG. 1.
Figure 3:
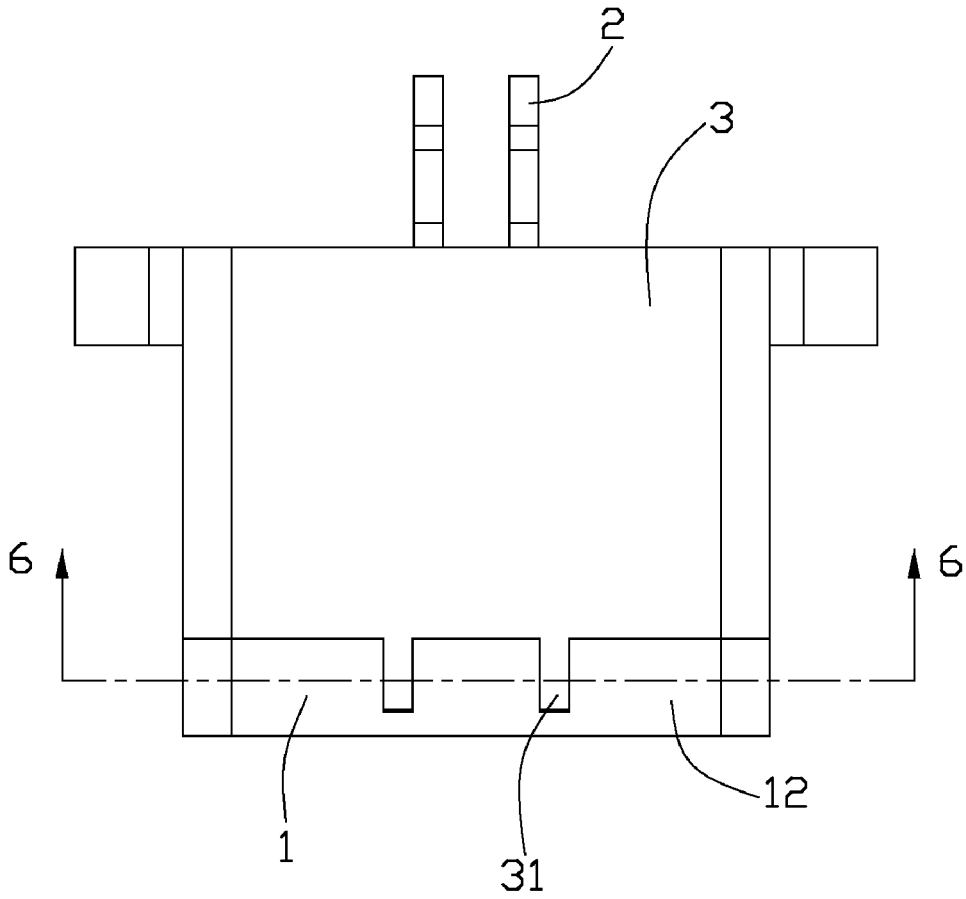
FIG. 3 is a vertical view of the electrical connector shown in FIG. 1.

Reference will now be made to the drawing figures to describe a preferred embodiment of the present invention in detail. Referring to FIG. 1 to FIG. 3, an electrical connector made according to the preferred embodiment of the present invention is provided and comprises an insulative housing 1, a plurality of contacts 2 and a metallic shell 3 surrounding the insulative housing 1.

Figure 4:
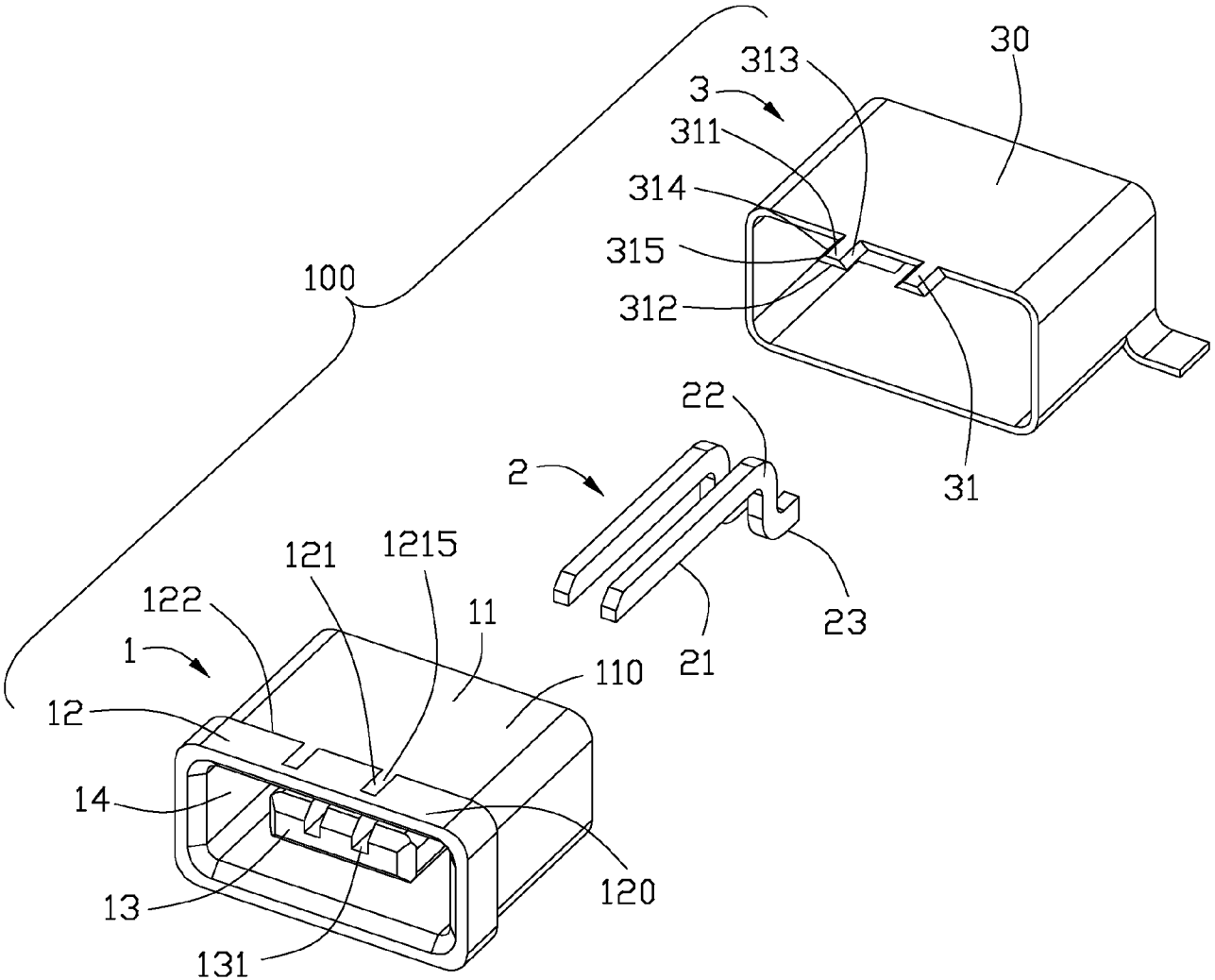
FIG. 4 is an exploded perspective view of the electrical connector shown in FIG. 1.
Figure 5:
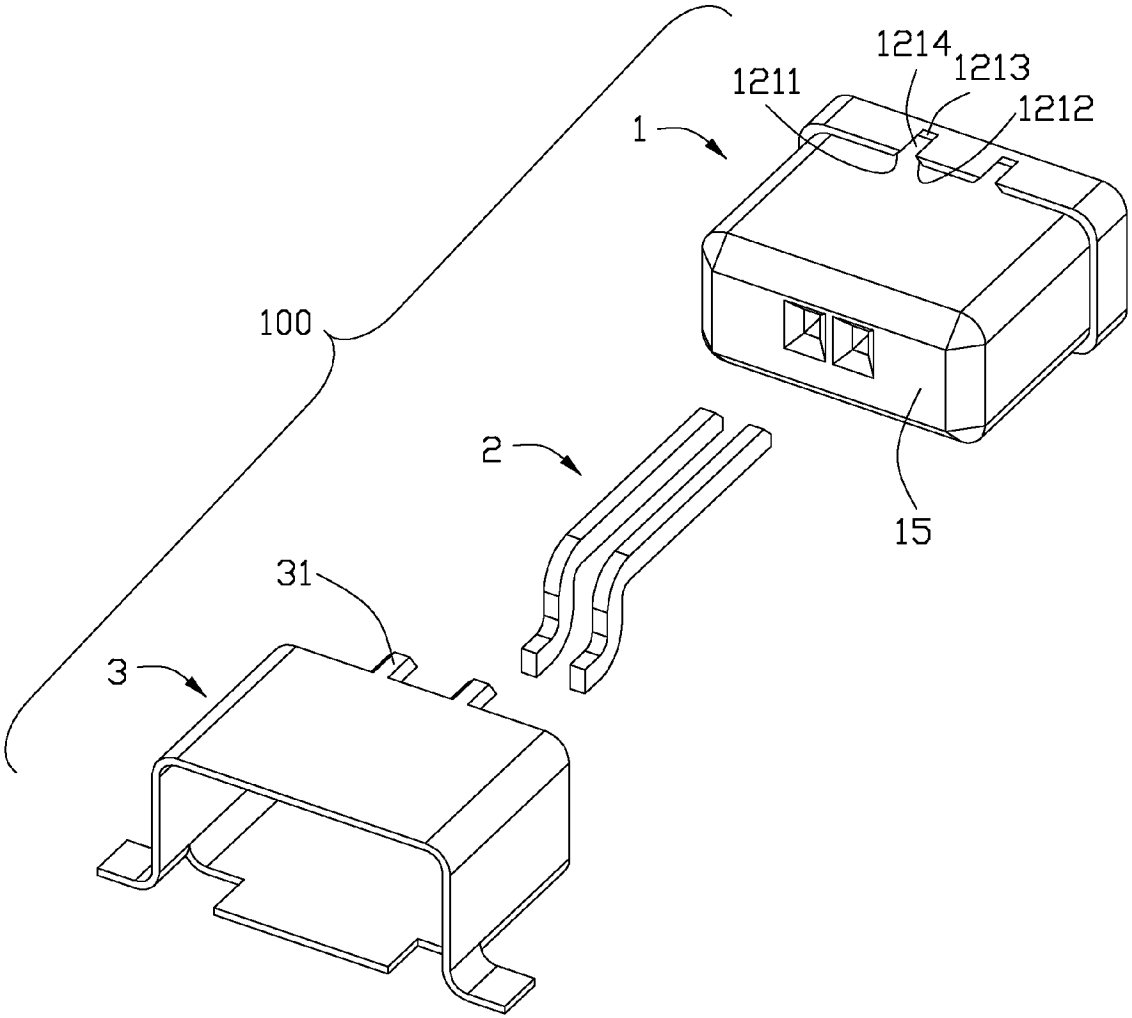
FIG. 5 is another exploded perspective view of the electrical connector shown in FIG. 1.

Referring to FIG. 4 to FIG. 5, the insulative housing 1 is in a rectangular shape and comprises a base portion 11 extending along a front-to-rear direction and a receiving room 14 defined in the base portion 11. The base portion 11 forms a rear wall 15 at a rear end thereof, on which a tongue plate 13 is formed and exposed in the receiving room 14. A plurality of terminal grooves 131 are defined on an upper side of the tongue plate 13 and runs through the rear wall 15 for receiving the contacts 2 therein. A strengthening rib 12 protrudes outwardly from an outer circumstance of a front section of the base portion 11 and locates adjacent to a front opening of the receiving room 14 for strengthening the rigidity of the base portion 11. A step configuration is formed between the strengthening rib 12 and the base portion 11, therefore a vertical connecting wall 122 is formed between an upper face 120 of the strengthening rib 12 and an upper face 110 of the base portion 11. A pair of receiving recesses 121 are defined on the strengthening rib 12 closer to the upper face 110 of the base portion 11 and running through the connecting wall 122 along the front-to-rear direction. Each receiving recess 121 communicates with an exterior beyond the upper face 120 of the strengthening rib 12 via an opening 1214 defined on the upper face 120. Each receiving recess 121 comprises a first side wall 1211, a second side wall 1212 at opposite transverse ends of the receiving recess 121 and a third side wall 1213 at a distal end of the receiving recess 121 and connects with the first and second side walls. Further, a bottom face 1215 is defined within the receiving recess 121 and connects with above mentioned side walls. The distance between the first and second side walls 1211, 1212 becomes narrower and narrower from the upper face 110 of the base portion 11 toward the opening 1214.

Referring to FIGS. 1, 2 and 4, each contact 2 comprises a retaining portion 22, a contacting portion 21 extending forwardly from a front end of the retaining portion 22, and a solder tail 23 extending downwardly from the other end of the retaining portion 22. The contacting portion 21 exposes in the receiving room 14 while the solder tail 23 projects beyond the rear wall 15.

Figure 6:
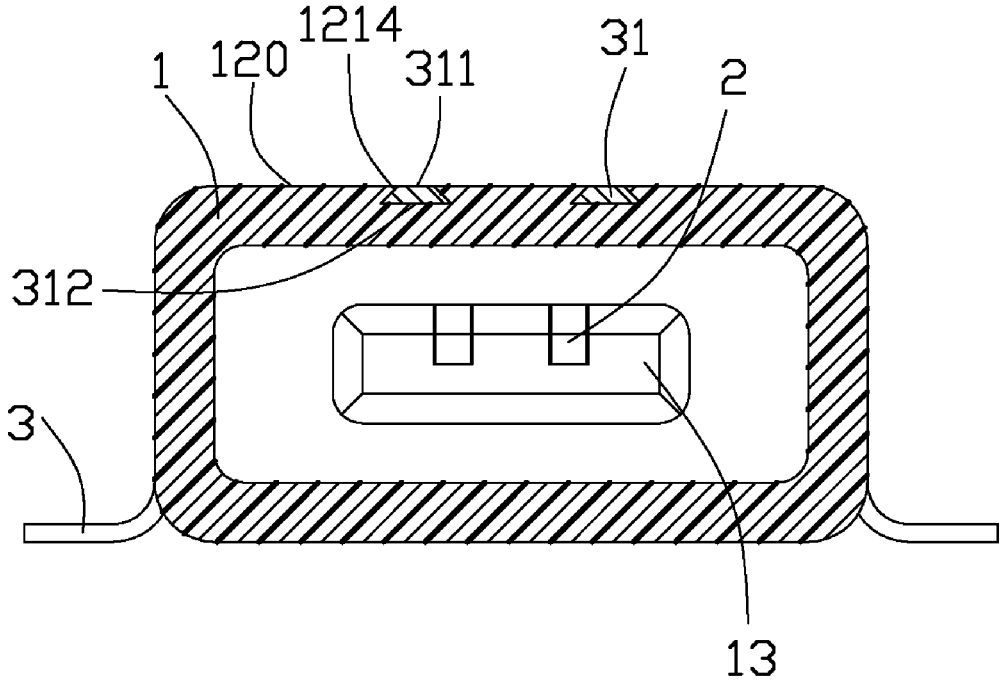
FIG. 6 is a cross-sectional view of the electrical connector shown in FIG. 3 along line 6-6.

Referring to FIG. 4 and FIG. 6, the metallic shell 3 is made by a metal sheet and surrounds the insulative housing 1. A pair of retaining plates 31 extend forward from a front edge of an upper wall 30 of the metallic shell 3. Each retaining plate 31 comprises an upper surface 311, a lower surface 312, and a first side surface 313, a second side surface 314 and a front surface 315 connecting with the upper surface 311 and lower surface 312. The distance between the first side surface 313 and the second side surface 314 becomes wider and wider from the upper surface 311 toward the lower surface 312.

When the electrical connector is assembled, the metallic shell 3 is assembled onto the insulative housing 1 along the front-to-rear direction. Meanwhile, the retaining plates 31 are inserted into the receiving recess 121, with the first side surface 313, second side surface 314, lower surface 312 and the front surface 315 respectively engaging with the first side wall 1211, second side wall 1212, bottom face 1215 and third side wall 1213, and the upper surface 311 properly received in the opening 1214. At this time, the upper surface 311 and the upper wall 30 are coplanar with the upper face 120 of the strengthening rib 12. So long as the upper surface 311 does not exceed the upper face 120 of the strengthening rib 12, the total height of the electrical connector will not be added.

Further, as the retaining plate 31 interferes with the receiving recess 121, which can support the strengthening rib 12 and prevent distortion of a front section of the insulative housing 1 when the electrical connector is mounted.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing having a base portion extending along a front-to-rear direction and a strengthening rib protruding outwardly from an outer circumstance of a front end of the base portion, at least one receiving recess being defined in the strengthening rib and opened upwardly via an opening defined on an upper face of the strengthening rib;

a plurality of contacts secured in the insulative housing; and a metallic shell surrounding the base portion, comprising at least one retaining plate received in said receiving recess; wherein a transverse width of the receiving recess becomes narrower and narrower in a vertical direction perpendicular to the front-to-rear direction so as to keep the retaining plate being secured.

2. The electrical connector as described in claim 1, wherein the at least one retaining plate does not exceed the upper face of the strengthening rib.

3. The electrical connector as described in claim 2, wherein an upper surface of the at least one retaining plate is coplanar with the upper face of the strengthening rib.

4. The electrical connector as described in claim 1, wherein the metallic shell further has a pair of solder tails extending from a rear end thereof, while the at least one retaining plate extends from a front end thereof.

5. The electrical connector as described in claim 4, wherein the insulative housing defines a receiving room with a tongue plate exposed therein.

6. An electrical connector comprising:

an insulative housing having a rear base portion and a front strengthening rib formed a step configuration toward the base portion, at least one receiving recess defined in the strengthening rib along a front-to-rear direction;

a plurality of contacts secured in the insulative housing; and a metallic shell having a front edge abutting against the strengthening rib and locked with the insulative housing via at least one retaining plate received in said receiving recess; wherein the receiving recess opens upwardly via an opening defined on an upper face of the strengthening rib, and a transverse width of the receiving recess is smaller and smaller toward the opening.

7. The electrical connector as described in claim 6, wherein a transverse dimension of an upper surface of the retaining plate is smaller than that of a lower surface of the retaining plate.

8. The electrical connector as described in claim 7, wherein said upper surface of the retaining plate is received in said opening.

* * * * *